United States Patent [19]

Lake et al.

[11] 4,431,560

[45] Feb. 14, 1984

[54] WASHING AND STORAGE SOLUTION FOR SEPARATION DEVICES

[75] Inventors: William Lake, Skokie; William J. Schnell, Wheeling, both of Ill.

[73] Assignee: Baxter Travenol Laboratories, Inc., Deerfield, Ill.

[21] Appl. No.: 453,080

[22] Filed: Dec. 27, 1982

[51] Int. Cl.[3] ..... C11D 7/08

[52] U.S. Cl. ..... 252/142; 134/42; 134/22.19; 252/106; 252/107; 252/117; 424/28; 424/311; 424/312; 424/319; 435/2; 435/188; 436/15; 436/16; 436/17; 436/18

[58] Field of Search ..... 252/106, 107, 117, DIG. 5; 134/42, 22.19; 435/2, 188; 436/15, 16, 17, 18, 8, 10; 424/311, 312, 319, 28

[56] References Cited

U.S. PATENT DOCUMENTS

| | | | |
|---|---|---|---|
| 3,552,928 | 1/1971 | Fetter et al. | 436/16 |
| 3,629,451 | 12/1971 | Cook et al. | 424/319 |
| 3,808,051 | 4/1974 | Schoenholz et al. | 134/38 X |
| 3,843,798 | 10/1974 | Cook et al. | 424/319 |
| 4,198,206 | 4/1980 | Ryan | 436/17 X |
| 4,206,077 | 1/1980 | Sarstedt et al. | 436/17 X |
| 4,337,269 | 6/1982 | Berke et al. | 424/311 X |

OTHER PUBLICATIONS

"Affinity Chromatography Principles and Methods", *Pharmacia,* Jun. 1979, pp. 93–94.

Justine Garvey et al., *Methods in Immunology,* 3rd Ed., W. A. Benjamin, Inc., Reding, Mass. (1977), p. 249.

*Primary Examiner*—John E. Kittle

*Assistant Examiner*—M. J. Shah

*Attorney, Agent, or Firm*—Paul C. Flattery; Garrettson Ellis

[57] ABSTRACT

An acidic solution of glycine and a fatty acid of 3 to 12 carbon atoms provides an improved solution for cleaning and storing blood dialyzers and other separation devices, particularly those intended for contact with blood after they have once been used.

15 Claims, No Drawings

WASHING AND STORAGE SOLUTION FOR SEPARATION DEVICES

TECHNICAL FIELD AND PRIOR ART

Dialyzers for blood are increasingly being reused, despite the recommendations of most manufacturers that they are for one-time use only. Several different machines for cleaning the dialyzers and filling them with storage solution after one use and prior to another use are now sold commercially. Typically, the used dialyzer is washed for 12 to 18 minutes, and thereafter it is filled with a formaldehyde-containing solution and stored in the filled condition until its reuse is desired. Thereafter, the dialyzer is flushed with dialysis solution to remove the formaldehyde solution and then the dialysis begins.

Formaldehyde, while a potent bactericidal agent, is highly toxic to humans as well as bacteria, so it is extremely important that no formaldehyde be allowed to remain in the dialyzer after flushing. However, by accident it may be possible for formaldehyde to pass from the dialyzer to the patient in sufficient quantity to be harmful. Furthermore, the regular exposure of the patient repeatedly over months or years to the small amounts of formaldehyde that cannot be easily flushed out of the reused dialyzers is though to be undesirable.

In accordance with this invention, a new washing and storage solution for dialyzers or the like intended for reuse is provided. The solution may also be used with other separation devices, particularly those which have been in contact with blood, such as membrane plasmapheresis devices, ultrafiltration devices, and filters, or other devices such as blood sets and other tubing.

DESCRIPTION OF INVENTION

The solution of this invention contains a sufficient concentration of glycine, a known protein residue desorbent and dispersant, or another monocarboxylic, monoamine amino acid, or any other appropriate protein residue desorbent, to provide the desired level of protein removal from a separation device which contains undesired protein residues, for example a dialyzer for blood which has been previously used. Typically from 0.5 to 2 molar solution of the desorbent, particularly glycine, may be used.

The solution also contains enough dissolved fatty acid or acids of typically 3 to 12 carbon atoms (but optionally up to 18 or more carbon atoms) to provide bacteriocidal conditions, particularly during storage, to a separation device which will contain the solution during the storage period. Typically from 0.03 to 1 percent by weight of such a fatty acid will be present. For example 0.1 percent by weight of hexanoic acid or octanoic acid may be provided to the solution, with the hexanoic acid being generally preferred because of its less unpleasant odor. If desired, a water-miscible organic solvent such as ethanol may be added to solubilize the fatty acid.

The solution may be buffered with hydrochloric acid or the like to an acidic pH, typically a pH of 1 or 2 to 4, and preferably about pH 2.5 to 3.5.

It further may be desirable to provide a color acid-base indicator, such as methyl orange or any other appropriate color indicator such as methylene blue, so that the solution can be readily identified, in contrast to the typically colorless saline solution which will be used to flush the separation device at the end of the storage period so that complete flushing can be achieved.

Also, methyl orange changes color at pH 3–4 so that the user can know when the pH of the system is rising.

However, even if small amounts of the solution of this invention do enter the patient during the dialysis procedure, neither amino acids such as glycine nor fatty acids such as hexanoic acid are notably toxic. In fact, they are both nutrients, and are easily handled by the metabolism. Nevertheless, in the concentrations and at the pH ranges indicated, the solution of this invention can be a potent solubilizer and disperser of protein residues, to desorb, disperse, and dissolve blood clots and fibrin in separation devices and tubing, and is also a powerful broad spectrum microbicidal agent, so that the dialyzer or other separation device and tubing can be stored under aseptic conditions.

While glycine is the typically preferred amino acid for use in this invention, other typically monocarboxylic monoamine amino acids may also be used such as alanine, leucine, valine, phenylalanine, serine, and the like. The term "monocarboxylic monoamine amino acid" refers to amino acids which contain one carboxylic acid and one amine group. Without intending to be bound by any theory as to the operation of the invention of this application, it is believed that such amino acids form a "Zwitter ion" that disrupts the noncovalent bonding of proteins to various substrates, thus facilitating the washing away of such protein-containing residues.

Other protein residue desorbent agents which may be used in this invention include the following materials which, along with glycine/HCl (pH 2.5) are disclosed as known desorbing agents for immunoadsorbents in a document published by Pharmacia entitled "Affinity Chromatography Principles and Methods" (June, 1979) particularly at pages 93 and 94: Phospate-citrate at pH 2.8 (specifically sodium phosphate-citrate; metal and alkaline earth salts (specifically the chlorides of sodium, magnesium and the like); salts of chaotropic ions, such as $SCN^-$, $CCl_3COO^-$, or iodide, specifically sodium salts or the like up to about 3 molar concentration, specifically sodium iodide; guanidine hydrochloride at 6 molar concentration or urea at 8 molar concentration, although it is contemplated that lower concentrations will also provide desirable effect; and as a final example, propylene glycol or glycerine in an aqueous solution concentration of up to 50% by weight. While the prior art cited above discloses the use of many of the above protein desorbing agents at neutral or alkaline pH, they are also believed to be effective at the desired acid pH (e.g., no more than pH 6) contemplated in the storage solutions of this invention.

As additionally taught in "Methods in Immunology, by Justine Garvey, et al., 3rd ed. W. A. Benjamin, Inc., Reding, Mass. (1977), particularly at page 249, additional desorbing agents for protein (called therein "hydrogen bond dissociation agents") include $ClO^-$ and particularly alkali salts thereof such as the sodium salt; two molar $NaClO_4$; two molar sodium salicylate, and others.

Other fatty acids which may be used include propionic acid, butyric acid, undecanoic acid, and dodecanoic acid, among others.

The solution of this invention may be used in conventional dialyzer reuse machines which are current available on the market. One may also use the solution in accordance with the invention described in the patent pplication of William R. Knab entitled "REUSE OF EPARATION DEVICES SUCH AS DIALYZ-:RS" and filed on the same day as this application, or in ny other washing system.

Specifically, a washing and storage solution in accor-ance with this invention may be water containing 1 iolar glycine, 0.1 percent by weight of n-hexanoic acid, .01 percent by weight of methyl orange, and sufficient ydrochloric acid to provide a pH of 2.75.

The above has been offered for illustrative purposes nly and is not intended to limit the scope of the inven-on of this application, which is as defined in the claims elow.

That which is claimed is:

1. A cleaning and storage solution for separation evices in contact with blood which comprises an cidic aqueous solution having an effective concentra-on of monocarboxylic, monoamine acid to provide the esired removal of protein residue from the device, in ombination with an amount of fatty acid having from to 12 carbon atoms in sufficient concentration to per-nit bacteriocidal storage of the separation device filled vith such solution.

2. The solution of claim 1 in which a color indicator present to provide a visible color to said solution, said olor indicator exhibiting a color change within the ange of pH 3–4.

3. The solution of claim 1 in which said fatty acid is exanoic acid.

4. The solution of claim 1 in which the pH is from 1 4.

5. The solution of claim 1 in which the amino acid is resent in a concentration of 0.5 to 2 M.

6. The solution of claim 1 in which the fatty acid is resent in a concentration of 0.03 to 1 weight percent.

7. The solution of claim 1 in which the amino acid is glycine.

8. A cleaning and storage solution for separation devices in contact with blood which comprises an aqueous solution containing glycine in a concentration of 0.5 to 2 M, to provide the desired removal of protein residue from the device, in combination with an amount of dissolved fatty acid having from 3 to 12 carbon atoms in a concentration of 0.03 to 1 weight percent, to permit bacteriocidal storage of the separation device filled with such solution, the pH of said solution being from 2 to 3.5.

9. The cleaning and storage solution of claim 8 which contains hydrochloric acid as a pH controlling agent.

10. The cleaning and storage solution of claim 9 in which said fatty acid has from 6 to 8 carbon atoms.

11. The cleaning and storage solution of claim 10 in which said fatty acid is hexanoic acid.

12. The cleaning and storage solution of claim 11 in which a color indicator is present to provide a visible color to said solution, said color indicator exhibiting a color change within the range of pH 3–4.

13. The cleaning and storage solution of claim 12 in which said hexanoic acid is present in a concentration of essentially 0.1 percent by weight.

14. The cleaning and storage solution of claim 10 in which said fatty acid is present in a concentration of at least 0.1 percent by weight.

15. A cleaning and storage solution for separation devices in contact with blood which comprises an acidic aqueous solution having an effective concentration of protein desorbent agent to provide the desired removal of protein residue from the device, in combination with an amount of fatty acid in sufficient concentration to permit bacteriocidal storage of the separation device filled with such solution.

* * * * *